US009546460B1

(12) United States Patent
Nicol

(10) Patent No.: US 9,546,460 B1
(45) Date of Patent: Jan. 17, 2017

(54) DOG FECES COLLECTION DEVICE

(71) Applicant: Charles Nicol, Manchester, MA (US)

(72) Inventor: Charles Nicol, Manchester, MA (US)

( * ) Notice: Subject to any disclaimer, the term of this patent is extended or adjusted under 35 U.S.C. 154(b) by 0 days.

(21) Appl. No.: 15/156,461

(22) Filed: May 17, 2016

Related U.S. Application Data

(60) Provisional application No. 62/179,837, filed on May 20, 2015.

(51) Int. Cl.
*B65G 7/12* (2006.01)
*B65G 9/00* (2006.01)
*E01H 1/12* (2006.01)

(52) U.S. Cl.
CPC ..... *E01H 1/1206* (2013.01)

(58) Field of Classification Search
CPC ..... E01H 1/1206; B65G 7/12; B25J 7/00; B25B 9/02
USPC ..... 294/1.3–1.4, 16, 99.1–99.2; D30/162
See application file for complete search history.

(56) References Cited

U.S. PATENT DOCUMENTS 4,019,768 A 4/1977 Niece
4,179,145 A 12/1979 Shinsako
4,900,077 A 2/1990 Beck
5,370,431 A * 12/1994 Henninger ..... E01H 1/1206 294/1.3
5,385,376 A 1/1995 Malaspina
D355,280 S 2/1995 Yoshioka
5,409,279 A 4/1995 Magee
5,620,220 A * 4/1997 Khoshnood ..... E01H 1/1206 294/1.3
5,876,079 A * 3/1999 Rycroft ..... E01H 1/1206 294/1.3
6,059,333 A * 5/2000 De Toma ..... E01H 1/1206 294/1.3
6,062,168 A 5/2000 Host
8,459,708 B1 * 6/2013 Sandorfi ..... A47J 43/283 294/104
2014/0319862 A1 * 10/2014 Ho ..... A47G 21/10 294/99.2

FOREIGN PATENT DOCUMENTS

CN 201546195 8/2010

* cited by examiner

*Primary Examiner* — Stephen Vu
(74) *Attorney, Agent, or Firm* — Kyle A. Fletcher, Esq.

(57) ABSTRACT

The dog feces collector is a hand held device adapted for use in picking animal feces up off the ground. The dog feces collector comprises a first leg and a second leg that are joined by a hinge. The end of the first leg and the end of the second leg that is distal from the hinge are both fitted with elements that when combined form a cage that is used to capture and collect the animal feces. The dog feces collector further comprises a first leg, a second leg, a hinge, a first leg extension and a second leg extension.

18 Claims, 6 Drawing Sheets

DOG FECES COLLECTION DEVICE

CROSS REFERENCES TO RELATED APPLICATIONS

This non-provisional application claims priority to United States provisional application U.S. 62/179,837 filed on May 20, 2015.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of waste collection devices, more specifically, a device adapted to pick up animal feces from the ground.

SUMMARY OF INVENTION

The dog feces collector is a hand held device adapted for use in picking animal feces up off the ground. The dog feces collector comprises a first leg and a second leg that are joined by a hinge. The end of the first leg and the end of the second leg that is distal from the hinge are both fitted with elements that when combined form a cage that is used to capture and collect the animal feces.

These together with additional objects, features and advantages of the dog feces collector will be readily apparent to those of ordinary skill in the art upon reading the following detailed description of the presently preferred, but nonetheless illustrative, embodiments when taken in conjunction with the accompanying drawings.

In this respect, before explaining the current embodiments of the dog feces collector in detail, it is to be understood that the dog feces collector is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dog feces collector.

It is therefore important that the claims be regarded as including such equivalent construction insofar as they do not depart from the spirit and scope of the dog feces collector. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
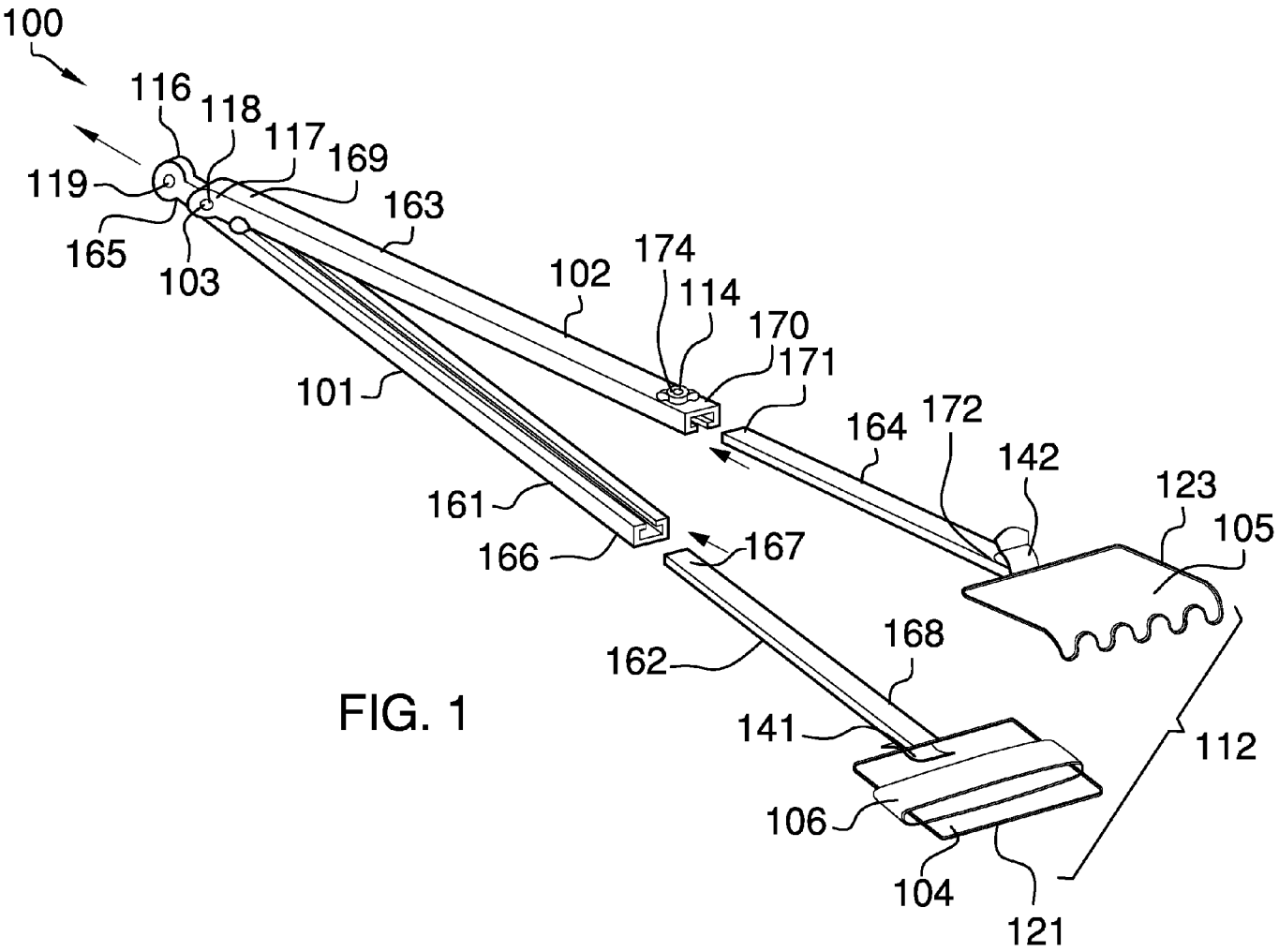
FIG. 1 is a perspective view of an embodiment of the disclosure.
Figure 2:
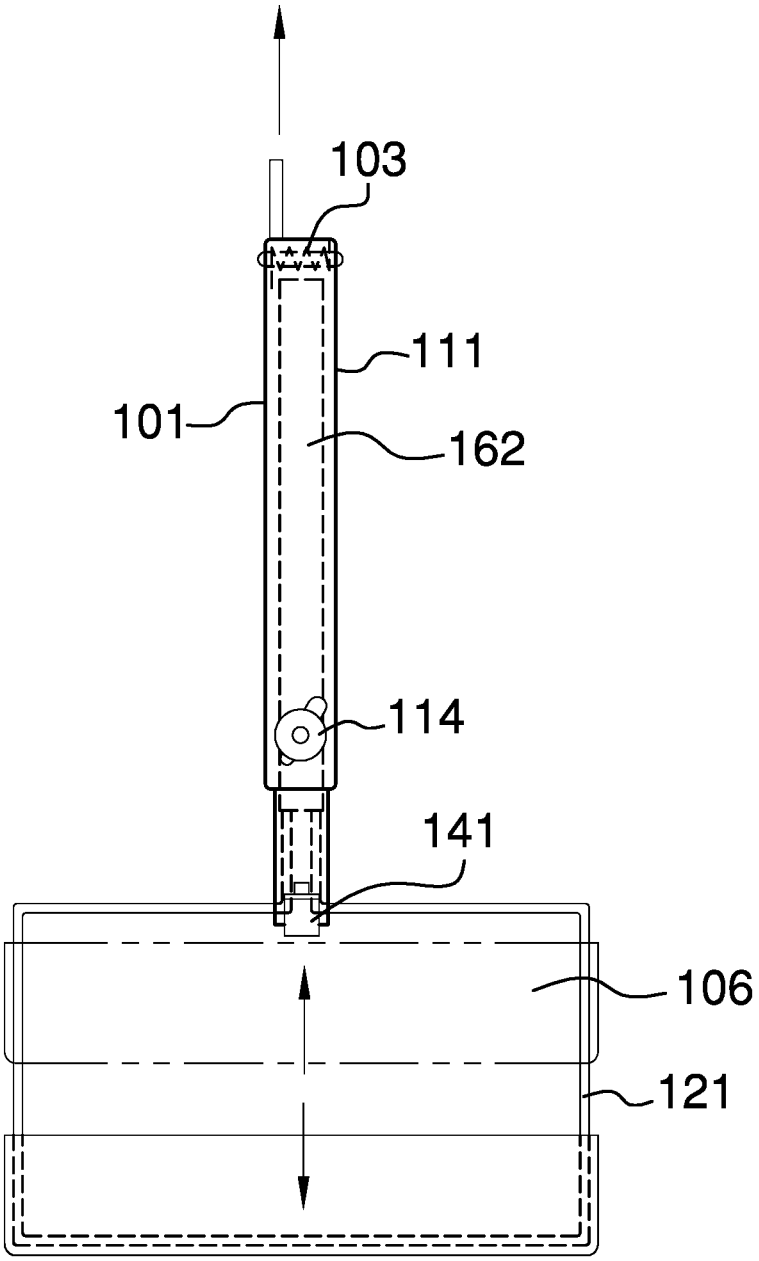
FIG. 2 is a bottom view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The dog feces collector 100 (hereinafter invention) further comprises a first leg 101, a second leg 102, a hinge 103, a first leg extension 104 and a second leg extension 105. The first leg extension 104 and the second leg extension 105 combine to form a capture device 112 that can be used to capture and transport animal feces 131 from the ground 132. The first leg extension 104 and the second leg extension 105 are attached to the first leg 101 and the second leg 102 respectively. The purpose of the first leg 101 and the second leg 102 is to extend the reach of the user such that the user can stand normally while using the invention 100. The first leg 101 and the second leg 102 are attached using the hinge 103 in order to facilitate manipulation of the invention 100.

The first leg 101 further comprises a first member 161 and a second member 162. The first member 161 is further defined with a first end 165 and a second end 166. The second member 162 further comprises a third end 167 and a fourth end 168. The first member 161 and the second member 162 are designed to form the first leg 101 in a telescopic manner. Specifically, the second member 162 is sized such that the third end 167 of the second member 162 will slide into the second end 166 of the first member 161. By adjusting the relative position of the third end 167 within the first member 161 the overall length of the first leg 101 can be adjusted. In the first potential embodiment of the disclosure, the first member 161 and the second member 162 are both formed from rectangular tubing. In a second potential embodiment of the disclosure, the first member 161 and the second member 162 are both formed from cylindrical tubing. The first end 165 of the first member 161 is further formed with a circular disk 116 that is used for decorative purposes but is also formed with a hook hole 119 to allow the invention 100 to be hung from a hook.

The second leg 102 further comprises a third member 163 and a fourth member 164. The third member 163 is further defined with a fifth end 169 and a sixth end 170. The fourth member 164 further comprises a seventh end 171 and an eighth end 172. The third member 163 and the fourth member 164 are designed to form the second leg 102 in a telescopic manner. Specifically, the fourth member 164 is sized such that the seventh end 171 of the fourth member 164 will slide into the sixth end 170 of the third member 163. By adjusting the relative position of the seventh end 171 within the third member 163 the overall length of the second leg 102 can be adjusted. In the first potential embodiment of the disclosure, the third member 163 and the fourth member 164 are both formed from rectangular tubing. In a second potential embodiment of the disclosure, the third member 163 and the fourth member 164 are both formed from cylindrical tubing. The fifth end 169 of the third member 163 is formed with a plurality of holes 117 that are sized to receive a hinge shaft 118. The hinge shaft 118 is a simple shaft that is positioned through the plurality of holes 117 and is used to hold the hinge 103 in position. The hinge 103 is discussed in more detail elsewhere in this disclosure.

The relative position of the first member 161 to the second member 162 is held in position through the use of a first thumbscrew 173. The first thumbscrew 173 is threaded through a screw hole 113 placed in the vicinity of the second end 166 of the first member 161. The first thumbscrew 173 is further defined with a ninth end 175 and a tenth end 176. When the first thumbscrew 173 is tightened through the screw hole 113, the ninth end 175 enters the hollow chamber of the first member 161 and presses against the outer surface of the second member 162. The pressure applied by the first thumbscrew 173 against the second member 162 serves to hold the second member 162 in position relative to the first member 161. The tenth end 176 of the first thumbscrew 173 is fitted with a thumbwheel 114 to facilitate the tightening and loosening of the first thumbscrew 173.

The relative position of the third member 163 to the fourth member 164 is held in position through the use of a second thumbscrew 174. The second thumbscrew 174 is threaded through a screw hole 113 placed in the vicinity of the sixth end 170 of the third member 163. The second thumbscrew 174 is further defined with an eleventh end and a twelfth end. When the second thumbscrew 174 is tightened through the screw hole 113, the eleventh end enters the hollow chamber of the third member 163 and presses against the outer surface of the fourth member 164. The pressure applied by the second thumbscrew 174 against the fourth member 164 serves to hold the fourth member 164 in position relative to the third member 163. The twelfth end of the second thumbscrew 174 is fitted with a thumbwheel 114 to facilitate the tightening and loosening of the second thumbscrew 174.

The hinge 103 is used to attach the first end 165 of the first member 161 and the fifth end 169 of the third member 163. The purpose of the hinge 103 is to: 1) hold the first leg 101 and the second leg 102 together; and, 2) to allow the first leg 101 to rotate relative to the second leg 102 thereby changing the relative angle 115 between the first member 161 and the third member 163. In all the potential embodiments of the disclosure discussed in this disclosure, the hinge 103 is a commercially available torsion spring that is designed to separate the first member 161 and the third member 163.

As described elsewhere in this disclosure, the first leg extension 104 and the second leg extension 105 combine to form a capture device 112. The first leg extension 104 is attached to the fourth end 168 of the second member 162 with a first spring loaded clip 141. The first spring loaded clip 141 allows the first leg extension 104 to be readily attached, detached and changed as required. The second leg extension 105 is attached to the eighth end 172 of the fourth member 164 with a second spring loaded clip 142. The second spring loaded clip 142 allows the second leg extension 105 to be readily attached, detached and changed as required. The first spring loaded clip 141 and the second spring loaded clip 142 are commercially available components.

In the majority of potential embodiments of the disclosure, the first leg extension 104 and the second leg extension 105 are described as a paddle that is formed in a certain shape. As used in this disclosure, the term paddle is used to describe a general structure of a specifically defined shape. The paddles itself can be constructed in several ways including, but not limited to, the use of a wire to form the outline of the specifically defined shape. When the wire outline is used the collection surface for the animal feces 131 is the waste bag 133 itself.

In a third potential embodiment of the disclosure, the first leg extension 104 is formed in the shape of a first rectangular paddle 121 and the second leg extension 105 is formed in the shape of a second rectangular paddle 122. When brought together, the surface of the first rectangular paddle 121 and the surface of second rectangular paddle 122 provide the friction necessary to capture and raise the animal feces 131.

In a fourth potential embodiment of the disclosure, the first leg extension 104 is an L shaped paddle 124. The L shaped paddle 124 comprises a third rectangular paddle 126 wherein a fourth rectangular paddle 127 projects perpendicularly away from the third rectangular paddle 126 in the direction towards the second leg extension 105. The fourth rectangular paddle 127 is located at the first bottom edge 128 of the third rectangular paddle 126. The second leg extension 105 is a claw paddle 123. The claw paddle 123 comprises a fifth rectangular paddle 151 that is further defined with a second bottom edge 152. The second bottom edge 152 of the fifth rectangular paddle 151 smoothly curves 154 towards the first leg extension 104. The second bottom edge 152 is formed with a plurality of ridges 153 that are intended to scrape through grass and loose materials to more effectively collect the animal feces 131.

In a fifth potential embodiment of the disclosure, the first leg extension 104 is identical to the first leg extension 104 of the third potential embodiment of the disclosure. The second leg extension 105 is a sixth rectangular paddle 155. The surface area of the sixth rectangular paddle 155 is between 20% and 33% of the size of the first leg extension 104.

In a sixth potential embodiment of the disclosure, the first leg extension 104 is identical to the first leg extension 104 of the fourth potential embodiment of the disclosure. The second leg extension 105 is similar to the second leg extension described 105 in the fifth potential embodiment of the disclosure, except that the surface area of the sixth rectangular paddle 155 is between 20% and 33% of the size of the size of the third rectangular paddle 126.

The invention 100 is fitted with a retainer 106. The retainer 106 is an elastic material that is used to hold the first leg extension 104 and the second leg extension 105 together during storage. The retainer 106 is primarily used to secure the waste bag 133 to either the first leg extension 104 or the second leg extension 105. Without the inclusion of the retainer 106, the waste bag 133 may become disengaged from the invention 100, and which may result in a mess.

The first member 161, second member 162, third member 163, and fourth member 164 can be formed from a molded plastic, such as polyvinylchloride, or a metal, such as aluminum. The remaining components discussed in this disclosure are commercially available.

Figure 3:
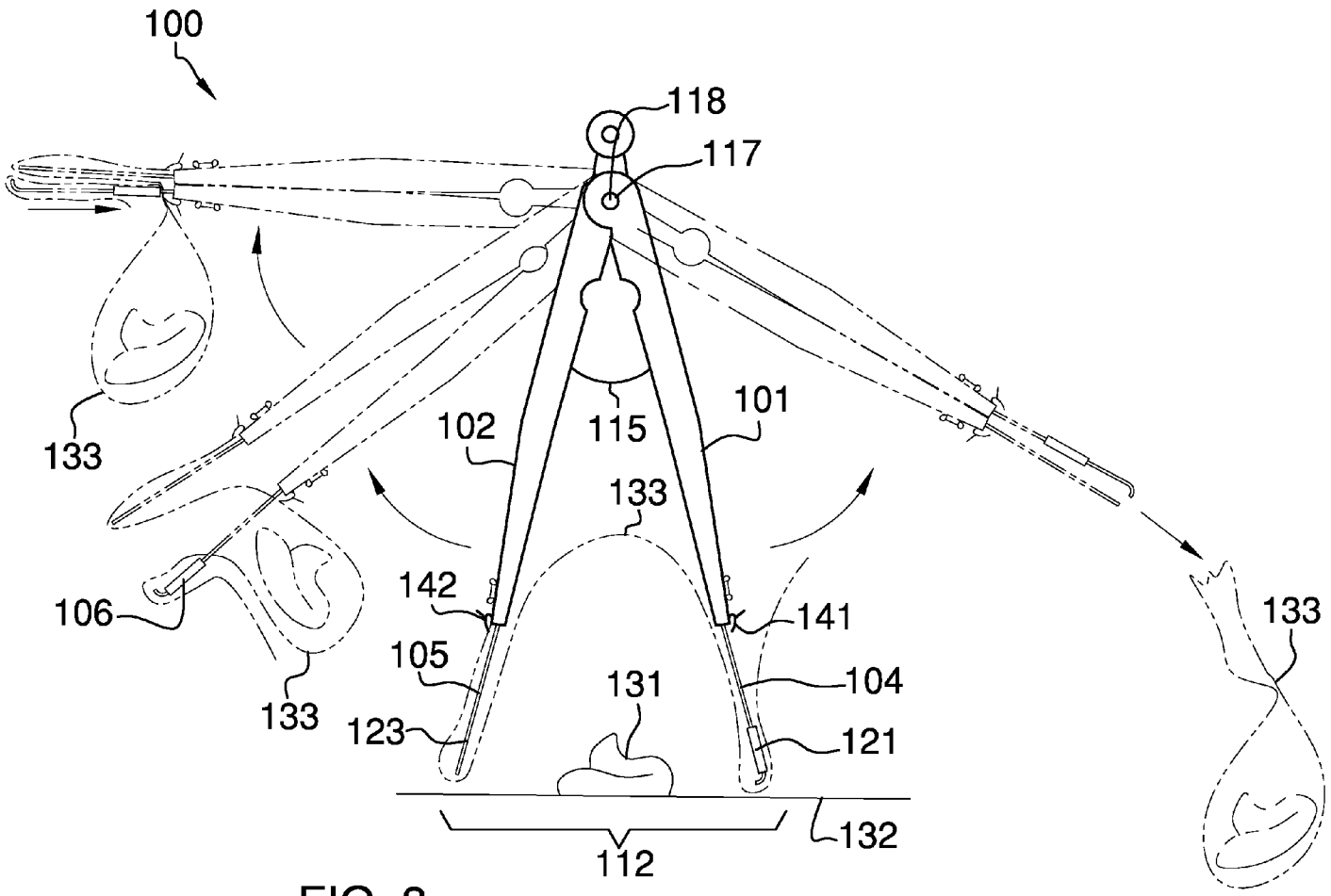
FIG. 3 is a side view of an embodiment of the disclosure.
Figure 4:
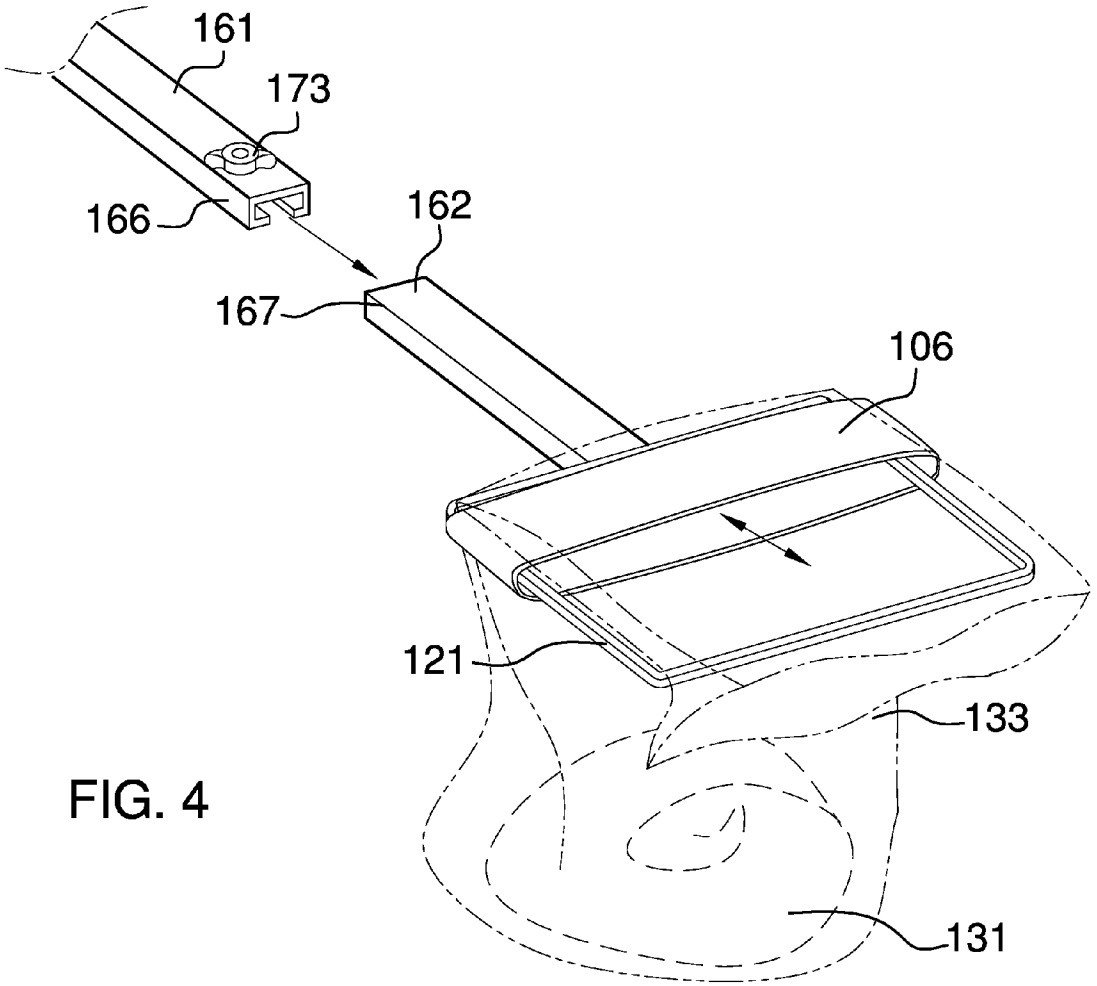
FIG. 4 is a detail view of an embodiment of the disclosure.
Figure 5:
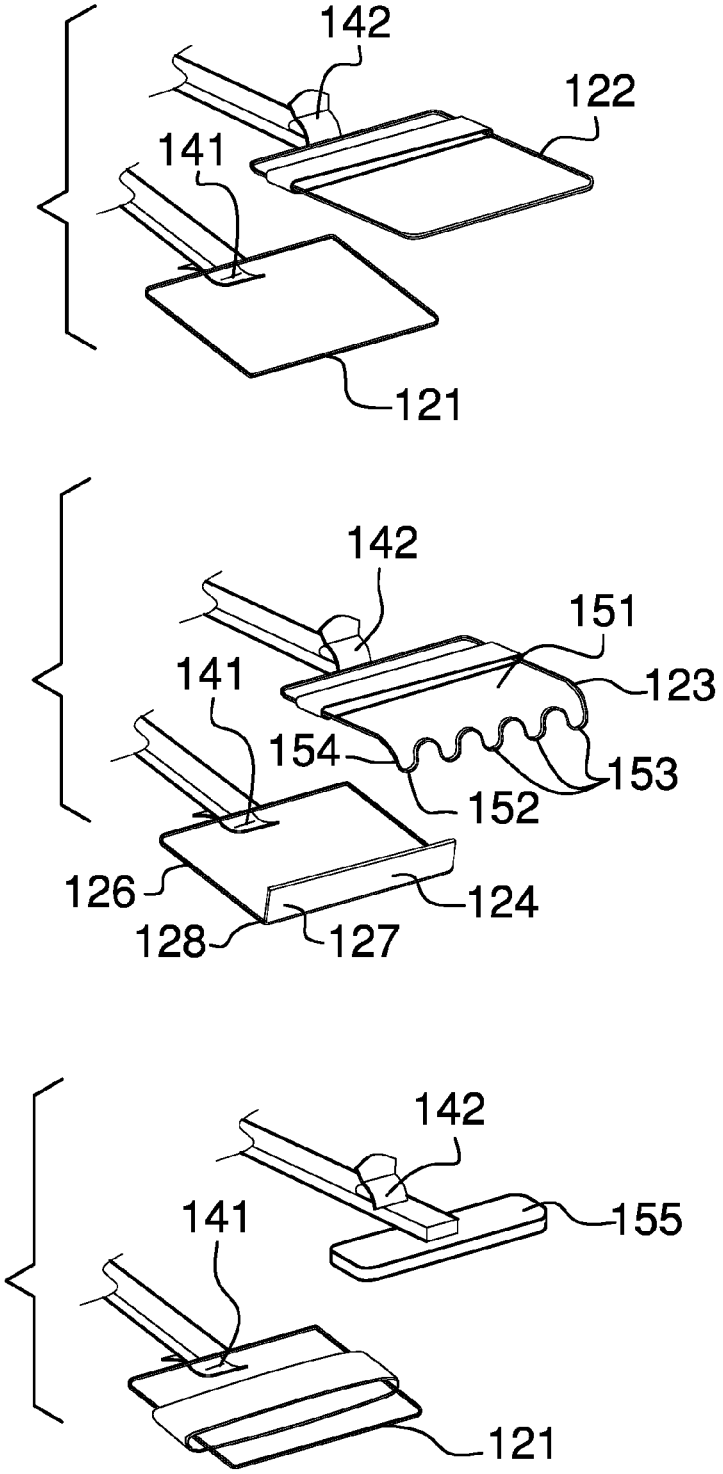
FIG. 5 is a detail view of alternative embodiments of the disclosure.
Figure 6:
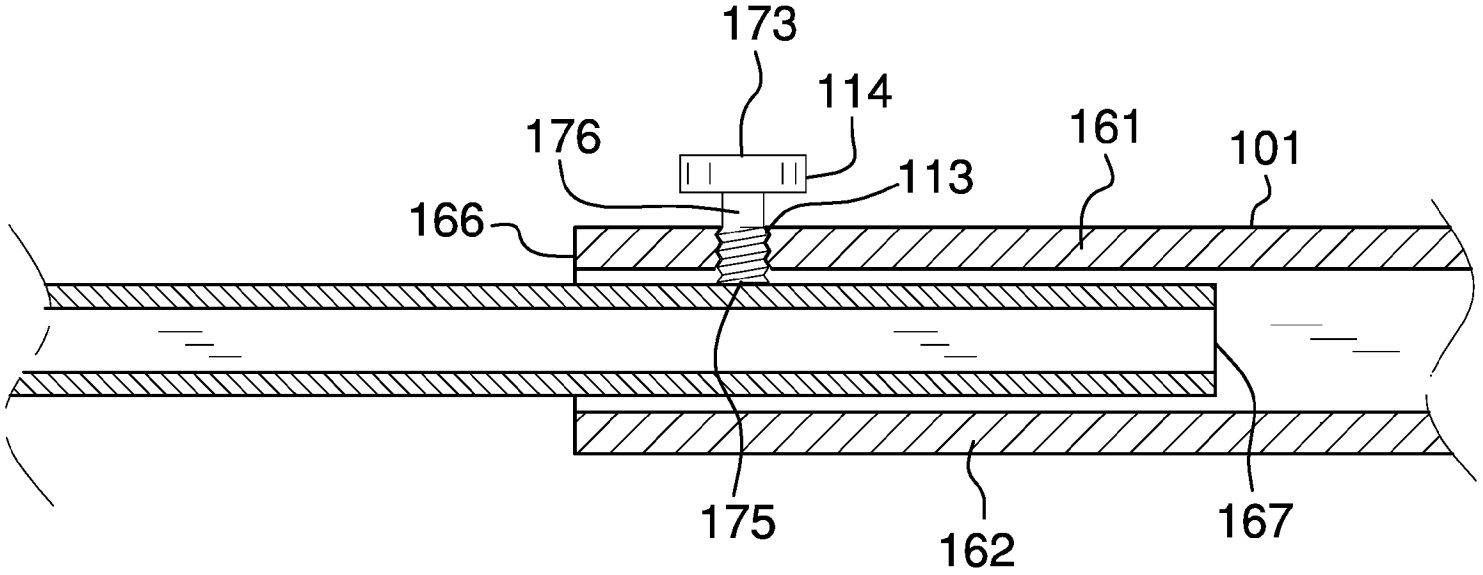
FIG. 6 is a detail view of an embodiment of the disclosure.

As shown most clearly in FIG. 3, to use the invention 100 a waste bag 133 is attached to the invention 100 by folding the opening of the waste bag 133 back upon itself such that the exterior surface of the waste bag 133 envelops the first leg extension 104, the second leg extension 105, and the retainer 106. The waste bag 133 envelops the first leg extension 104, the second leg extension 105, and the retainer 106 such that the first leg extension 104, the second leg extension 105, and the retainer 106 are protected from the animal feces 131 by the waste bag 133. The waste bag 133 is folded back upon itself such that friction between the waste bag 133 and the invention 100 will hold the waste bag 133 in position. The user then places the first leg extension 104 and the second leg extension 105 around the targeted feces animal feces 131. The user then squeezes the first member 161 and the third member 163 together to close the first leg extension 104 and the second leg extension 105 to form the capture device 112 such that the waste bag 133 will surround and thereby capture the animal feces 131 within the waste bag 133 in such a manner that neither the first leg extension 104, the second leg extension 105 nor the retainer 106 will come in contact with the animal feces 131 as the animal feces 131 is pushed into the waste bag 133.

As shown in FIG. 3, the weight of the captured animal feces 131 will cause the waste bag 133 to fall to the side of the first leg extension 104 and the second leg extension 105 from where the waste bag 133 can then be disposed of. The falling to the side of the waste bag 133 will cause the animal feces 131 to fall further into the waste bag 133 in such a manner that space is made for the subsequent capture of animal feces 131 within the waste bag 133 if necessary. Waste bags marketed for the disposal of pet waste are suitable for use as described in this paragraph.

The following definitions were used in this disclosure:

Elastic: As used in this disclosure, an elastic is a material or object that deforms when a force is applied to it and that is able to return to its original shape after the force is removed.

Hinge: As used in this disclosure, a hinge is a device that permits the turning, rotating, or pivoting of a first object relative to a second object.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance.

Telescopic: As used in this disclosure, telescopic is an adjective that describes an object made of sections that fit or slide into each other such that the object can be made longer or shorter.

Tube: As used in this disclosure, a tube is a hollow device with a first open end and a second open end that can be used for transporting liquids and or gasses.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A collection device comprising:

a first leg, a second leg, a hinge, a first leg extension and a second leg extension;

wherein the collection device is adapted for use in collecting animal feces;

wherein the first leg extension and the second leg extension combine to form a capture device that is used to collect animal feces;

wherein the first leg and the second leg are spring loaded;

wherein the first leg extension and the second leg extension are attached to the first leg and the second leg respectively;

wherein the first leg comprises a first member and a second member;

wherein the first member is further defined with a first end and a second end;

wherein the second member further comprises a third end and a fourth end;

wherein the first member and the second member is joined to form the first leg in a telescopic manner;

the second leg further comprises a third member and a fourth member;

wherein the third member is further defined with a fifth end and a sixth end;

wherein the fourth member further comprises a seventh end and an eighth end;

wherein the third member and the fourth member is joined to form the second leg in a telescopic manner;

wherein the relative position of the first member to the second member is held in position through the use of a first thumbscrew;

wherein the relative position of the third member to the fourth member is held in position through the use of a second thumbscrew.

2. The collection device according to claim 1 wherein the hinge attaches the first end of the first member and the fifth end of the third member.

3. The collection device according to claim 2 wherein the hinge comprises a torsion spring.

4. The collection device according to claim 3 wherein the first leg extension is attached to the fourth end of the second member;

wherein the second leg extension is attached to the eighth end of the fourth member;

wherein the first leg extension is attached to the fourth end of the second member using a first spring loaded clip;

wherein the second leg extension is attached to the eighth end of the fourth member using a second spring loaded clip.

5. The collection device according to claim 4 wherein the collection device further comprises a waste bag;

wherein the waste bag is further defined with an opening;

wherein the waste bag is attached to the collection device by folding the opening of the waste bag back upon itself such that the exterior surface of the waste bag envelops the first leg extension, the second leg extension, and a retainer;

wherein the retainer is used to secure the waste bag over either the first leg extension or the second leg extension in order to prevent unintended contact between feces and the first leg extension or the second leg extension.

6. The collection device according to claim 5 wherein the first leg extension is formed in the shape of a first rectangular paddle.

7. The collection device according to claim 6 wherein the second leg extension is formed in the shape of a second rectangular paddle.

8. The collection device according to claim 7 wherein the first rectangular paddle is formed from wire;

wherein the second rectangular paddle is formed from wire.

9. The collection device according to claim 6 wherein the second leg extension is a second rectangular paddle;

wherein the surface area of the second rectangular paddle is between 20% and 33% of the size of the first leg extension.

10. The collection device according to claim 9 wherein the first rectangular paddle is formed from wire; wherein the second rectangular paddle is formed from wire.

11. The collection device according to claim 5 wherein the first leg extension is an L shaped paddle.

12. The collection device according to claim 11 wherein the L shaped paddle further comprises a second rectangular paddle and a third rectangular paddle.

13. The collection device according to claim 12 wherein the third rectangular paddle projects perpendicularly away from the second rectangular paddle in the direction towards the second leg extension.

14. The collection device according to claim 13 wherein the second leg extension is a claw paddle.

15. The collection device according to claim 14 wherein the claw paddle comprises a fifth rectangular paddle that is further defined with a first bottom edge;

wherein the first bottom edge of the fifth rectangular paddle smoothly curves towards the first leg extension;

wherein the first bottom edge is formed with a plurality of ridges.

16. The collection device according to claim 15 wherein the L shaped paddle is formed from wire;

wherein the claw paddle is formed from wire.

17. The collection device according to claim 11 wherein the L shaped paddle further comprises a second rectangular paddle and a third rectangular paddle;

wherein the third rectangular paddle projects perpendicularly away from the second rectangular paddle in the direction towards the second leg extension;

the second leg extension is a fourth rectangular paddle;

wherein the surface area of the fourth rectangular paddle is between 20% and 33% of the size of the second rectangular paddle.

18. The collection device according to claim 17 wherein the L shaped paddle is formed from wire;

wherein the fourth rectangular paddle is formed from wire.

* * * * *